US009617651B2

(12) United States Patent
Kobayashi et al.

(10) Patent No.: US 9,617,651 B2
(45) Date of Patent: Apr. 11, 2017

(54) ANODIZING APPARATUS AND ANODIZING METHOD

(71) Applicant: Aisin Seiki Kabushiki Kaisha, Kariya-shi (JP)

(72) Inventors: Daishi Kobayashi, Kariya (JP); Megumi Hirose, Kariya (JP); Masaki Kato, Kariya (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 507 days.

(21) Appl. No.: 14/094,948

(22) Filed: Dec. 3, 2013

(65) Prior Publication Data

US 2014/0151239 A1 Jun. 5, 2014

(30) Foreign Application Priority Data

Dec. 5, 2012 (JP) ..... 2012-266375
Oct. 28, 2013 (JP) ..... 2013-223056

(51) Int. Cl.
*C25D 11/02* (2006.01)
*C25D 11/04* (2006.01)
(Continued)

(52) U.S. Cl.
CPC ..... *C25D 11/005* (2013.01); *C25D 11/022* (2013.01); *C25D 17/06* (2013.01); *C25D 21/10* (2013.01)

(58) Field of Classification Search
CPC ..... C25D 11/005; C25D 11/02; C25D 11/04; C25D 21/10
(Continued)

(56) References Cited

U.S. PATENT DOCUMENTS 2,549,678 A * 4/1951 Fiandt ..... C25D 1/00 204/212
4,102,770 A * 7/1978 Moriarty ..... C25D 21/10 204/212
(Continued)

FOREIGN PATENT DOCUMENTS

JP 52-023534 A * 2/1977
JP 57-161091 A * 10/1982
(Continued)

OTHER PUBLICATIONS

Machine translation of Kojima et al (JP 2006-336050).*

*Primary Examiner* — Harry D Wilkins, III
(74) *Attorney, Agent, or Firm* — Oblon, McClelland, Maier & Neustadt, L.L.P.

(57) ABSTRACT

An anodizing apparatus configured to perform an anodization on a metallic material to be processed provided with a projecting portion on a surface thereof, includes: an electrolysis tank configured to store electrolytic solution for anodization; a first electrode portion formed of a metal and electrically connected to the material in an immersed state immersed in the electrolytic solution in the electrolysis tank; a second electrode portion formed of a metal and opposing the material in the immersed state; an electrode apparatus configured to apply a predetermined voltage between the first and second electrode portions; a retaining device configured to retain and rotate the material in the immersed state; and a first injection device configured to inject the electrolytic solution toward a predetermined area deviated from the material in a storage space in the electrolysis tank so that the material is deviated from a line in the direction of injection.

4 Claims, 9 Drawing Sheets

(51) Int. Cl.
*C25D 11/00* (2006.01)
*C25D 17/06* (2006.01)
*C25D 21/10* (2006.01)

(58) Field of Classification Search
USPC ..... 204/224 R
See application file for complete search history.

(56) References Cited

U.S. PATENT DOCUMENTS

| | | | | | |
|---|---|---|---|---|---|
| 4,152,221 | A * | 5/1979 | Schaedel | C25D 11/04 | 205/108 |
| 4,225,399 | A * | 9/1980 | Tomita | C25D 11/08 | 204/274 |
| 6,126,808 | A * | 10/2000 | Rasmussen | C25D 5/08 | 204/225 |
| 2002/0008026 | A1 * | 1/2002 | Yamamoto | C25D 17/06 | 204/434 |

FOREIGN PATENT DOCUMENTS

| | | |
|---|---|---|
| JP | 11-236696 | 8/1999 |
| JP | 2002-129381 A * | 5/2002 |
| JP | 2006-336050 | 12/2006 |
| JP | 2008-291302 | 12/2008 |

* cited by examiner

ANODIZING APPARATUS AND ANODIZING METHOD

CROSS REFERENCE TO RELATED APPLICATIONS

This application is based on and claims priority under 35 U.S.C. §119 to Japanese Patent Applications 2012-266375 filed on Dec. 5, 2012 and 2013-223056 filed on Oct. 28, 2013, the entire content of which are incorporated herein by reference.

TECHNICAL FIELD

This disclosure relates to a technology for anodizing metallic material to be processed.

BACKGROUND DISCUSSION

In the related art, JP 11-236696 A (Reference 1), JP 2008-291302 A (Reference 2), and JP 2006-336050 A (Reference 3) disclose various technologies for anodizing metallic material to be processed. Reference 1 discloses a technology for controlling a flow rate of electrolytic solution injected from a plurality of injection nozzles to a material to be processed so as to prevent heat burning of the material to be processed at the time of anodization. References 2 and 3 disclose a technology for injecting electrolytic solution toward an outer periphery of a material to be processed while rotating the cylindrical material to be processed so as to prevent heat burning of the material to be processed at the time of the anodization.

The technology disclosed in Reference 2 has a potential to suppress a surface temperature of the material to be processed to achieve enhancement of heat burning prevention in comparison with the technology disclosed in Reference 1 by rotating the material to be processed at the time of anodization. Specifically, however, in a case where the anodization is performed on the metallic material to be processed having a projecting portion on the surface thereof, a further technology which achieve uniformization of a thickness of an anodized film by suppressing a temperature rise of part of the surface of the material to be processed is required.

SUMMARY

Thus, a need exists for a technology which is not susceptible to the drawback mentioned above.

An aspect of this disclosure is directed to an apparatus for performing anodization on a metallic material to be processed provided with a projecting portion on a surface thereof, and including an electrolysis tank, a first electrode portion, a second electrode portion, an electrode apparatus, a retaining device, and a first injection device.

The electrolysis tank has a function that stores electrolytic solution for the anodization. The first electrode portion is configured as a metallic portion electrically connected to the material to be processed in an immersed state immersed in the electrolytic solution in the electrolysis tank. The second electrode portion is configured as a metallic portion and opposing the material to be processed in the immersed state. The electrode apparatus has a function that applies a predetermined voltage between the first electrode portion and the second electrode portion. By an operation of the electrode apparatus, the anodization on the material to be processed is started. The retaining device has a function that retains and rotates the material to be processed in the immersed state. Rotating the material to be processed by the retaining device during the anodization helps to remove the heat generated in the material to be processed during the anodization, and form a uniform anodized film on the entire surface of the material to be processed.

The first injection device injects the electrolytic solution for the anodization toward a predetermined area deviated from the material to be processed in a storage space in the electrolysis tank so that the material to be processed is deviated from a line in the direction of injection. In this case, the probability that the electrolytic solution injected from the first injection device is directed directly toward the material to be processed is lowered. Therefore, variations in surface temperature of the material to be processed is suppressed from occurring during the anodization by a turbulent flow caused by the direct effect of the electrolytic solution on the material to be processed during the rotation. Consequently, the thickness of the anodized film formed on the surface of the material to be processed is suppressed from becoming uneven.

Another aspect of this disclosure is directed to a method of anodizing a metallic material to be processed provided with a projecting portion on the surface thereof, and including one or more steps. The steps include immersing the material to be processed in an electrolysis tank in which electrolytic solution for the anodization is stored, rotating the material to be processed, and applying a predetermined voltage between a first electrode portion electrically connected to the material to be processed in the immersed state and a second electrode provided at a position opposing the material to be processed in the immersed state in the electrolysis tank. In the steps, the electrolytic solution for the anodization is injected toward a predetermined area deviated from the material to be processed in a storage space in the electrolysis tank so that the material to be processed is deviated from a line in the direction of injection. In this case, the probability that the electrolytic solution is directed directly toward the material to be processed is lowered. Therefore, variations in surface temperature of the material to be processed are suppressed from occurring during the anodization by a turbulent flow caused by the direct effect of the electrolytic solution on the material to be processed during the rotation. Consequently, the thickness of the anodized film formed on the surface of the material to be processed is suppressed from becoming uneven.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
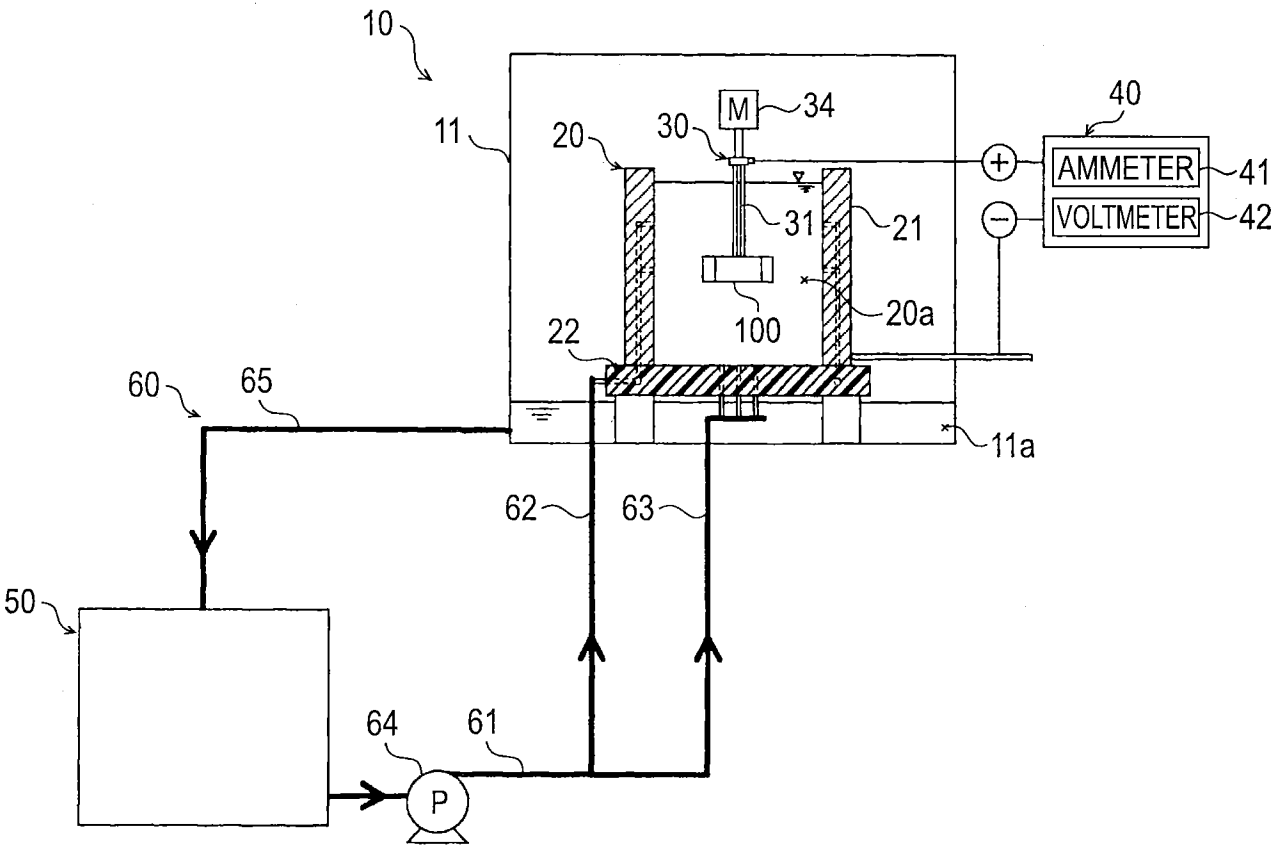
FIG. 1 is a drawing illustrating a schematic configuration of an anodizing apparatus of a first embodiment.

Referring now to the drawings, embodiments disclosed here will be described.

First Embodiment

FIG. 1 illustrates a schematic configuration of an anodizing apparatus 10 of a first embodiment of an "anodizing apparatus" disclosed here. The anodizing apparatus 10 is an apparatus for performing an anodization on a metallic material to be processed (also referred to as "work") 100. The anodizing apparatus 10 includes an electrolysis tank 20 to be stored in a storage container 11, a retaining device 30 mounted on the electrolysis tank 20, an electrode apparatus 40, an electrolytic solution tank 50, and an electrolytic solution transfer apparatus 60 as components thereof. Typical examples of the anodization include a process of providing the material to be processed formed of aluminum with anode and electrochemically oxidizing the material to be processed by using electrolytic solution having an acidic property such as sulfuric acid or chromic acid, whereby generating a film of aluminum oxide (anodized film) on the surface thereof.

The electrolysis tank 20 has a function that stores electrolytic solution for the anodization. The electrolysis tank 20 is provided with a cylindrical portion 21 having a circular cross section that forms a side wall and a bottom portion 22 configured to close one of openings (upper opening) of the cylindrical portion 21. The bottom portion 22 is formed of a resin, and the cylindrical portion 21 is formed of a metal. The cylindrical portion 21 has a function of a cylindrical electrode. A space defined by the cylindrical portion 21 and the bottom portion 22 is configured as a storage space 20*a* for storing electrolytic solution. In other words, the storage space 20*a* is defined by an inner peripheral surface of the cylindrical portion 21 and an inner surface of the bottom portion 22. The material to be processed 100 in a state of being retained by the retaining device 30 is entirely immersed in the electrolytic solution stored in the storage space 20*a*. Accordingly, application of the anodization on the entire surface of the material to be processed 100 is achieved. The electrolysis tank 20 corresponds to an "electrolysis tank" disclosed here. The storage container 11 includes a storage space 11*a* that stores electrolytic solution overflowed from the electrolysis tank 20.

The retaining device 30 includes a pair of metallic retaining members 31 for retaining the material to be processed 100 in the immersed state immersed in the electrolytic solution in the electrolysis tank 20 in a rotating state, and a motor 34 configured to rotate the material to be processed 100 retained by the pair of retaining members 31. In this case, one or more of retaining members 31 extending longitudinally in a direction intersecting a liquid surface of the electrolytic solution in the electrolysis tank 20 may be used. The retaining device 30 has a function that rotates the material to be processed 100 in the immersed state immersed in the electrolytic solution in the electrolysis tank 20 in a state of being retained, and corresponds to a "retaining device" disclosed here.

The electrode apparatus 40 is an apparatus for electrically connecting the electrolysis tank 20 and the retaining members 31 of the retaining device 30 to power sources, respectively, and includes an ammeter 41, a voltmeter 42, and a rectifier (not illustrated). In the electrode apparatus 40, an anode (plus) is electrically connected to the retaining members 31 of the retaining device 30, while a cathode (minus) is electrically connected to the cylindrical portion (cylindrical electrode) 21 of the electrolysis tank 20. Therefore, the material to be processed 100 connected to the anode of the electrode apparatus 40 via the retaining members 31 has a function of an anode for the anodization and the cylindrical portion (cylindrical electrode) 21 of the electrolysis tank 20 connected to the cathode of the electrode apparatus 40 has a function of a cathode for the anodization. The electrode apparatus 40 has a function that applies a predetermined voltage between the electrolysis tank 20 and the retaining members 31 of the retaining device 30, and corresponds to an "electrode apparatus" disclosed here.

The electrolytic solution tank 50 is a tank for storing electrolytic solution (also referred to as "processing solution"). The electrolytic solution is supplied from the electrolytic solution tank 50 to the electrolysis tank 20 at the time of the anodization of the material to be processed 100, and collected from the electrolysis tank 20 to the electrolytic solution tank 50. The temperature of the electrolytic solution is increased at the time of anodization, and hence an apparatus for cooling the electrolytic solution is preferably provided in the electrolytic solution tank 50 or in the periphery thereof.

The electrolytic solution transfer apparatus 60 is provided with a supply pipe 61, a discharge pump 64, and a correcting pipe 65. The supply pipe 61 is for supplying electrolytic solution stored in the electrolytic solution tank 50 to the storage space 20*a* of the electrolysis tank 20. The supply pipe 61 is branched to a first branched pipe 62 and a second branched pipe 63, and is connected to the electrolysis tank 20. The discharge pump 64 is connected to the supply pipe 61, and has a function that applies a high pressure to the electrolytic solution stored in the electrolytic solution tank 50 to eject the electrolytic solution. The correcting pipe 65 is configured to return electrolytic solution overflowed from the electrolysis tank 20 and stored in the storage space 11*a* of the storage container 11 to the electrolytic solution tank 50. In this case, in order to simplify the structure, it is preferable to arrange the electrolytic solution tank 50 at a position lower than the storage space 11*a* of the storage container 11, and employs a structure to return the electrolytic solution to the electrolytic solution tank 50 via the correcting pipe 65 by using a difference in height. In contrast, a structure in which the electrolytic solution is returned from the storage space 11*a* of the storage container 11 into the electrolytic solution tank 50 by using a translation mechanism such as a pump may be employed.

Figure 2:
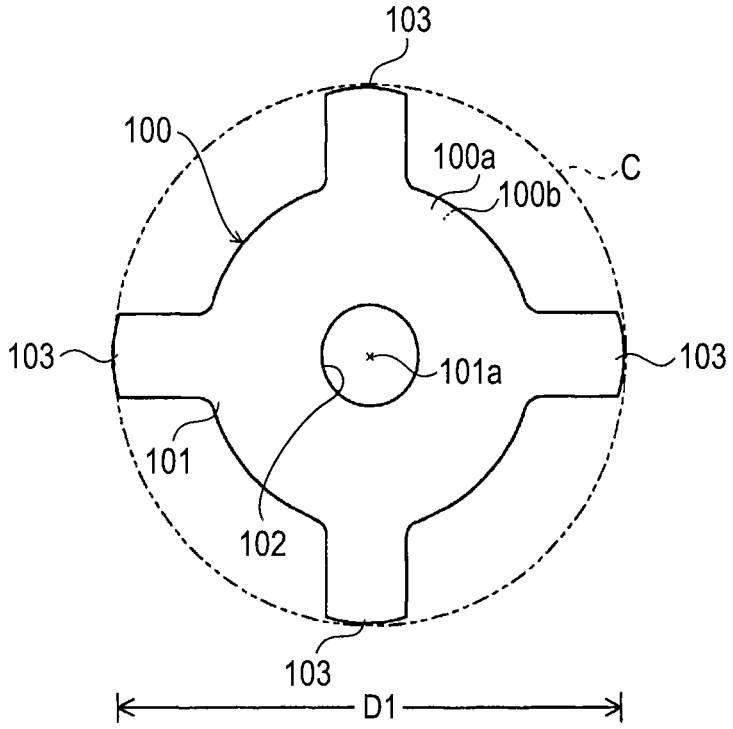
FIG. 2 is a plan view of a material to be processed in FIG. 1.

The material to be processed 100 is formed of a plate-shaped metallic material (aluminum alloy). As illustrated in FIG. 2, the material to be processed 100 includes a disk-shaped main body portion 101 extending along the liquid surface of the electrolytic solution in the electrolysis tank 20 and four projecting portions (also referred to as "projecting strips") 103 projecting from the main body portion 101 radially from a center portion 101*a* along the liquid surface of the electrolytic solution in the electrolysis tank 20. An outline (outer profile) of the material to be processed 100 is defined by an imaginary circle C passing distal end portions of the four projecting portions 103, for example, (circle having a diameter of D1). The main body portion 101 has a through hole 102 in which the pair of retaining members 31 are inserted. In a state in which the pair of retaining members 31 are inserted into the through hole 102, the main body portion 101 and the pair of retaining members 31 are connected to each other with a coupling mechanism (not illustrated), so that the material to be processed 100 is retained by the retaining device 30. In other words, the main body portion 101 of the material to be processed 100 corresponds to the practical retaining portion of the retaining device 30. In a state in which the material to be processed 100 is retained by the retaining device 30, the four projecting portions 103 of the material to be processed 100 extend in the direction orthogonal to the direction of extension of the retaining members 31.

Figure 3:
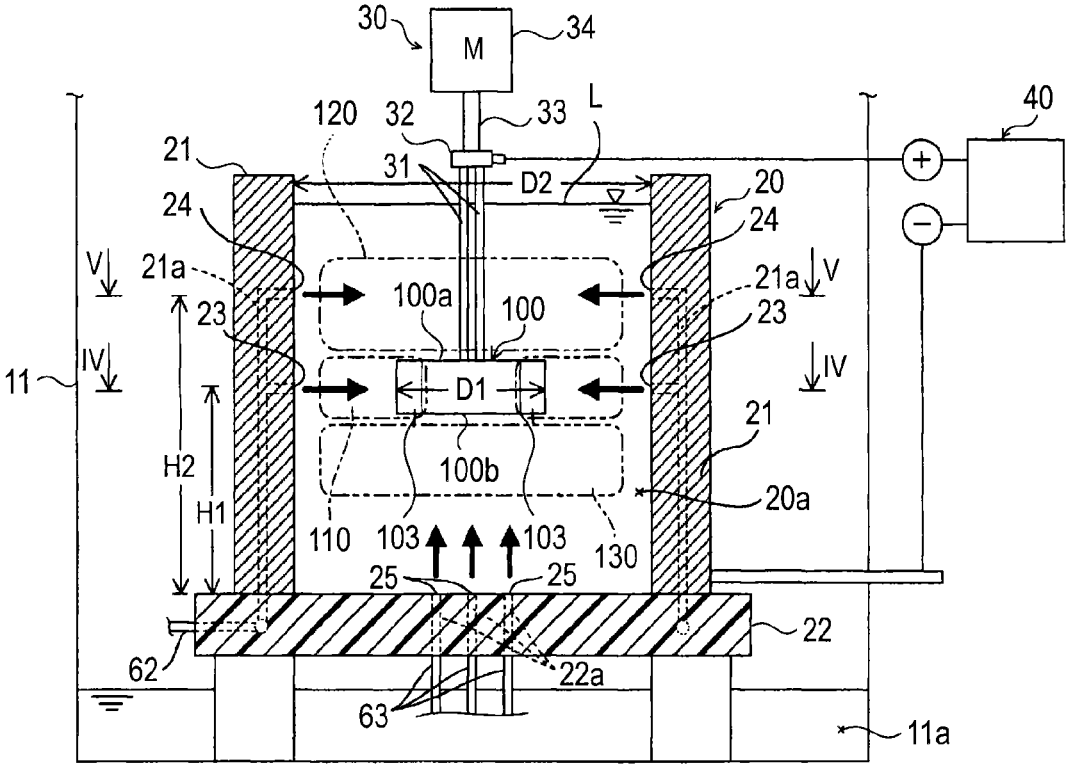
FIG. 3 is a drawing illustrating a schematic configuration of an electrolysis tank in FIG. 1.
Figure 4:
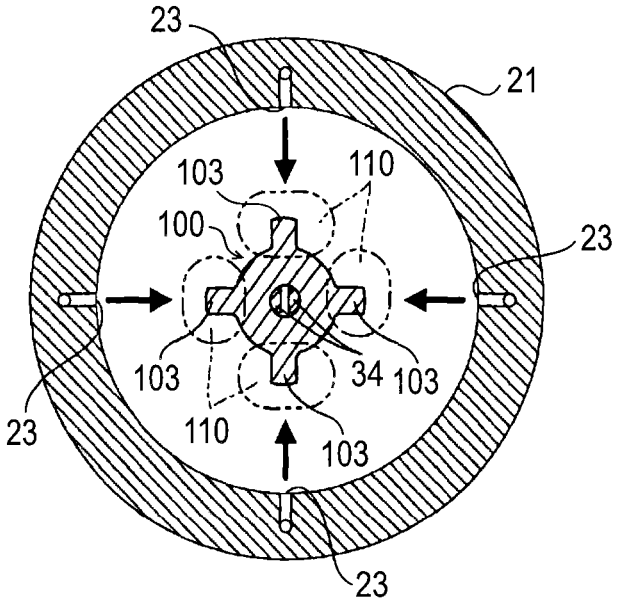
FIG. 4 is a drawing illustrating a cross-sectional structure of the electrolysis tank along IV-IV in FIG. 3.
Figure 5:
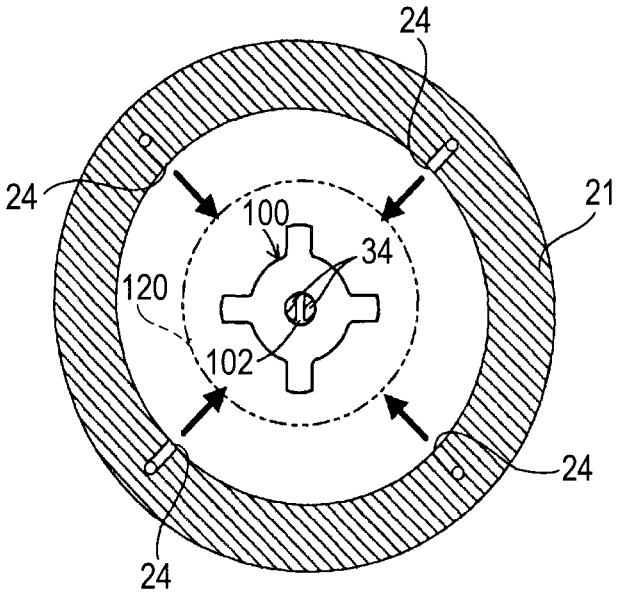
FIG. 5 is a drawing illustrating a cross-sectional structure of the electrolysis tank along V-V in FIG. 3.

Detailed structures of the electrolysis tank 20 and the retaining device 30 will be illustrated in FIG. 3 to FIG. 5.

As illustrated in FIG. 3, in the retaining device 30, rotation of a rotating shaft 33 connected to the motor 34 is transmitted to the two elongated shaft-shaped retaining members 31 electrically connected to the anode of the electrode apparatus 40 via a current-carrying portion 32. Therefore, the pair of retaining members 31 rotate about the rotating shaft 33 together with the material to be processed 100 by the motor 34 being driven. The motor 34 is configured as a drive unit configured to rotate the elongated shaft-shaped pair of retaining members 31 about the axis thereof. Typical structures of the retaining device 30 include a structure having a contact surface area (anode surface area) between the pair of retaining members 31 and the material to be processed 100 set to, for example, 16 $mm^2$. The current-carrying portion 32 and the pair of retaining members 31 correspond to electrode portions electrically connected to the material to be processed 100 in the immersed state immersed in the electrolytic solution in the electrolysis tank 20, and constitutes a "first electrode portion" disclosed here.

As illustrated in FIG. 3, the cylindrical portion 21 of the electrolysis tank 20 is provided with injection ports 23 and injection ports 24 communicating with the first branched pipe 62 of the electrolytic solution transfer apparatus 60. In other words, the first branched pipe 62 communicates with the injection ports 23 and the injection ports 24 via through channels 21*a* formed in the electrolysis tank 20 so as to penetrate therethrough. The bottom portion 22 of the electrolysis tank 20 is provided with injection ports 25 communicating with the second branched pipe 63 of the electrolytic solution transfer apparatus 60. In other words, the second branched pipe 63 communicates with the injection ports 25 via through channels 22*a* formed in the electrolysis tank 20 so as to penetrate therethrough. The injection ports 23, 24, and 25 are formed for injecting electrolytic solution into the storage space 20*a* of the electrolysis tank 20, and, typically, are 4 to 8 each of injection ports set to have the diameters of 4 to 8 mm. In this case, with the provision of the through channel communicating with each of the injection ports 23 to 25 in the electrolysis tank 20, injection piping or the like for injecting electrolytic solution does not have to be provided separately, and hence the structure of the injection device may be simplified. The cylindrical portion 21 of the electrolysis tank 20 corresponds to electrode portion provided at a position opposing the material to be processed 100 in the immersed state immersed in the electrolytic solution in the electrolysis tank 20, and constitutes a "second electrode portion" disclosed here. In this case, the metallic electrolysis tank 20 has a storage function that stores the electrolytic solution, and an electrode function of the second electrode portion concurrently. In other words, the second electrode portion corresponds to the entire part of the electrolysis tank 20. Accordingly, the structure of the second electrode portion may be simplified.

The injection ports 23 are formed as openings on an inner wall surface of the cylindrical portion 21 of the electrolysis tank 20 at positions at a first height H1 from the bottom surface of the electrolysis tank 20. As illustrated in FIG. 4, the plurality of (four in FIG. 4) injection ports 23 are preferably provided so as to be capable of injecting electrolytic solution into the storage space 20*a* toward the areas of projecting portions 110 corresponding to the four projecting portions 103 of the material to be processed 100. One or more of the injection ports 23 may be allocated to each of the areas of projecting portions 110. In this case, the areas of projecting portions 110 are defined as areas including the respective projecting portions 103 of the material to be processed 100 and the peripheral area thereof in the storage space 20*a* of the electrolysis tank 20. The injection ports 23 constitute the injection device (which corresponds to a "third injection device" disclosed here) for injecting electrolytic solution toward the projecting portions 103 (the areas of projecting portions 110 of the storage space 20*a*) of the material to be processed 100 together with the electrolytic solution transfer apparatus 60, and the through channels 21*a* in the electrolysis tank 20 which communicate the first branched pipe 62.

The injection ports 24 are formed as openings on the inner wall surface of the cylindrical portion 21 of the electrolysis tank 20 at positions at a second height H2 (>H1) from the bottom surface of the electrolysis tank 20. As illustrated in FIG. 5, the plurality of (four in FIG. 5) injection ports 24 are preferably provided so as to be capable of injecting electrolytic solution from the side of the material to be processed 100 toward an upper area 120 provided above the material to be processed in the storage space. In this case, the upper area 120 is defined by a liquid surface L of the electrolytic solution, an upper surface 100*a* of the material to be processed 100, and the inner wall surface of the cylindrical portion 21 in the storage space 20*a* of the electrolysis tank 20. The electrolytic solution from the injection ports 24 is injected toward the upper area 120 deviated from the material to be processed 100 in the storage space 20*a* of the electrolysis tank 20 so that the material to be processed 100 is deviated from lines in the directions of injection. Essentially, when axial lines of injection from the injection ports 24 are elongated, the material to be processed 100 does not intersect the axial lines of injection of the injection ports 24. The upper area 120 corresponds to a "predetermined area" and an "upper area" disclosed here. The injection ports 24 constitute the injection device (which corresponds to a "first injection device" disclosed here) for injecting electrolytic solution toward the upper area 120 in the storage space 20*a* together with the electrolytic solution transfer apparatus 60, and the through channels 21*a* in the electrolysis tank 20 which communicate the first branched pipe 62.

The injection ports 24 preferably have a function that injects electrolytic solution toward the center portion 101*a* of the material to be processed 100 in the upper area 120. In this case, in addition to an effect of diffusing the electrolytic solution staying in the upper area 120, a cooling effect of the upper surface 100*a* of the material to be processed 100 is improved by electrolytic solution injected toward the center portion 101*a* of the material to be processed 100. The injection ports 24 preferably have a function that injects electrolytic solution toward an area close to the upper surface 100*a* of the material to be processed 100 than to the liquid surface L of electrolytic solution of the electrolysis tank 20 in the upper area 120. In this case, the electrolytic solution is injected to an area in the proximity to the upper surface 100*a* of the material to be processed 100 in terms of the vertical direction (depth direction) of the electrolysis tank 20. Accordingly, the effect of diffusing the electrolytic solution staying in the upper area 120 is improved, and a cooling effect of the upper surface 100*a* of the material to be processed 100 is improved.

The injection ports 25 are formed as openings on an inner wall surface (bottom surface) of the bottom portion 22 of the electrolysis tank 20 at positions below the material to be processed 100 retained by the retaining device 30. A plurality of the injection ports 25 are preferably provided so as to be capable of injecting electrolytic solution toward a lower area 130 located below the material to be processed 100 in the storage space 20*a*. In this case, the lower area 130 is defined by the inner wall surface of the bottom portion 22, the lower surface of the material to be processed 100, and the inner wall surface of the cylindrical portion 21 in the storage space 20*a* of the electrolysis tank 20. The lower area 130 corresponds to a "lower area" disclosed here. The injection ports 25 constitute the injection device (which corresponds to a "second injection device" disclosed here) for injecting electrolytic solution toward the lower area 130 of the storage space 20*a* together with the electrolytic solution transfer apparatus 60, and the through channels 22*a* in the electrolysis tank 20 which communicate the second branched pipe 63.

In a method of performing the anodization of the material to be processed 100 by using the anodizing apparatus 10 having the configuration described above (anodizing method), for example, the following steps may be employed. In contrast, the anodization is not limited to the steps given below, and modifications may be made as needed such as exchange or addition of procedure.

First of all, the material to be processed 100 in the state of retained by the retaining device 30 is set in the storage space 20*a* in the electrolysis tank 20. Subsequently, the motor 34 is driven and the discharge pump 64 is activated to establish a circulation of electrolytic solution between the electrolytic solution tank 50 and the electrolysis tank 20. In other words, the electrolytic solution in the electrolytic solution tank 50 is pressurized by the discharge pump 64 and is discharged, and is supplied to the electrolysis tank 20 via the first branched pipe 62 and the second branched pipe 63 of the supply pipe 61. The electrolytic solution in the electrolysis tank 20, being increased beyond an upper edge of the cylindrical portion 21 and is overflowed, is stored once in the storage space 11*a* of the storage container 11, and then is collected in the electrolytic solution tank 50 through the correcting pipe 65. When the motor 34 is driven, the rotation is transmitted to the material to be processed 100 via the rotating shaft 33 and the pair of retaining members 31. Accordingly, the material to be processed 100 rotates about the center portion 101*a*. At this time, since the material to be processed 100 is provided with the projecting portions (projecting strips) 103 projecting along the liquid surface of the electrolytic solution in the electrolysis tank (projecting in the direction intersecting the axial line of the rotating shaft 33), the projecting portions 103 provide the electrolytic solution with a strong stirring effect. With this stirring effect, the liquid surface L of the electrolytic solution subjected to a centrifugal force is liable to be depressed on the center side of rotation of the material to be processed 100 and rise on the outside of rotation of the material to be processed 100 (on the side of the inner wall surface of the cylindrical portion 21), so that the electrolytic solution is easily overflowed from the electrolysis tank 20. In the embodiment disclosed here, the center portion 101*a* of the material to be processed 100 is arranged coaxially with the rotating shaft 33, the pair of retaining members 31, and the cylindrical portion 21 which is a cylindrical electrode.

In the electrolysis tank 20, the electrolytic solution is injected from the respective injection ports 23, 24, and 25, so that a flow of the electrolytic solution is formed in the storage space 20*a*. In this case, a flow rate control mechanism to control the injection flow rate of the electrolytic solution is preferably provided downstream of the discharge pump 64, specifically, upstream of the respective injection ports.

The electrolytic solution injected from the injection ports 23 is supplied from the side of the material to be processed 100 toward the areas of projecting portions 110 corresponding thereto in the storage space 20*a*, and directly acts on the projecting portions 103 of the material to be processed 100. The projecting portions of the material to be processed 100 are susceptible to increase in temperature due to a power concentration and, consequently, the thickness of the anodized film formed on the projecting portions tends to be relatively larger. Therefore, by positively cooling the projecting portions 103 of the material to be processed 100 by the electrolytic solution injected from the injection ports 23, the thickness of the anodized film formed on the surfaces of the projecting portions 103 is prevented from becoming thicker than that on other parts.

Electrolytic solution injected from the injection ports 24 is supplied from the side of the material to be processed 100 toward the upper area 120 positioned above the material to be processed 100 in the storage space 20*a*. The electrolytic solution diffuses the electrolytic solution staying in the upper area 120, whereby the cooling of the material to be processed 100 is accelerated. In particular, the electrolytic solution at a high temperature can stay easily in the upper area 120 by a convection generated by the temperature rise of the electrolytic solution at the time of the anodization, whereby the temperature of the upper surface 100*a* of the material to be processed 100 relatively rises. However, by positively injecting the electrolytic solution at a low temperature to the upper area 120, the electrolytic solution at a high temperature in the upper area 120 is diffused and hence the temperature difference between the upper surface 100*a* of the material to be processed 100 and other portions may be cancelled. Consequently, the thickness of the anodized film formed on the upper surface 100*a* of the material to be processed 100 is suppressed from becoming larger than that on other portions. The electrolytic solution injected from the injection ports 24 when the liquid surface L is depressed as described above has a function that pushes the electrolytic solution provided with a centrifugal force by the stirring effect of the projecting portions 103 back toward the center of rotation of the material to be processed 100. Accordingly, the electrolytic solution in the electrolysis tank 20 is prevented from flying in all directions out of the electrolysis tank 20 due to the excessive overflow.

The electrolytic solution injected from the injection ports 25 is supplied from below of the material to be processed 100 toward the lower area 130 positioned below the material to be processed 100 in the storage space 20*a*. The lower surface is positively cooled by the direct effect of the electrolytic solution on the lower surface of the material to be processed 100. The electrolytic solution injected from the injection ports 25 is capable of suppressing local stay of the electrolytic solution by the diffusing effect of the electrolytic solution in the lower area 130, whereby cooling of the material to be processed 100 may be accelerated.

In the first embodiment, since the electrolysis tank 20 is formed of the circular cylindrical portion 21 in cross section, the flow of the electrolytic solution formed in the storage space 20*a* when the electrolytic solution is injected from the injection ports 23, 24, and 25 respectively may be uniformized, and the distance between the electrodes (the distance between the material to be processed 100 as an anode and the cylindrical portion 21 as a cathode) is uniformized. As a typical structure of the cylindrical portion 21 of the electrolysis tank 20, an inner diameter D2 of the cylindrical portion 21 is set to a range from two times to three times the outer diameter D1 of the material to be processed 100 (see FIG. 3). This configuration is preferable for suppressing the local stay of the electrolytic solution while securing the amount of the electrolytic solution required for cooling the material to be processed 100 uniformly in the electrolysis tank 20. The shape of the cross section of the cylindrical portion 21 may be other shapes such as an oval or a polygon than circle.

Subsequently, the electrode apparatus 40 is operated so as to apply a predetermined voltage with respect to the material to be processed 100. Accordingly, the practical anodization of the material to be processed 100 immersed entirely in the electrolytic solution in the storage space 20*a* is executed. During the anodization, heat is generated in the material to be processed 100 while forming the anodized film on the surface of the material to be processed 100. At this time, rotating the material to be processed 100 in a state in which the entire part of the material to be processed 100 is immersed in the electrolytic solution helps to remove the heat generated in the material to be processed 100 during the anodization, and form a uniform anodized film on the entire surface of the material to be processed 100. By setting the speed of rotation of the motor 34 to a range from 100 rpm to 400 rpm, heat removal is achieved specifically efficiently.

A result of execution of the anodization under the process conditions given below by using the anodizing apparatus 10 configured as described above will be described.

Result of Execution

Figure 6:
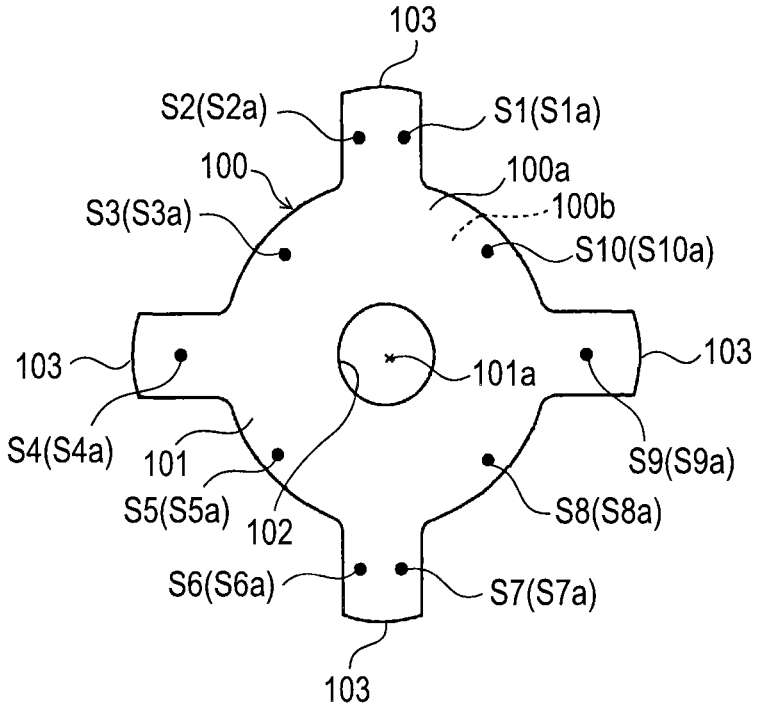
FIG. 6 is a drawing illustrating temperature measuring points set on the surface of the material to be processed in FIG. 2.

The temperature rise on the surface of the material to be processed 100 at the time when the anodization was executed under the above-described process conditions will now be described. In this case, temperatures of a plurality of temperature measuring points on the surface of the material to be processed 100 during the anodization were measured by using a predetermined temperature measuring mechanism (for example, a thermocouple). Specifically, as illustrated in FIG. 6, temperature measuring points S1 to S10 were set on part of the upper surface 100*a* of the material to be processed 100 opposing the liquid surface (the liquid surface L in FIG. 3) of the electrolysis tank 20, and temperature measuring points S1a to S10a were set on a lower surface 100*b* on a side opposite to the upper surface 100*a*. Specifically, the temperature measuring points S3, S3a, S5, S5a, S8, S8a, S10, and S10a were set on the main body portion 101 of the material to be processed 100, and the temperature measuring points S1, S1a, S2, S2a, S4, S4a, S6, S6a, S7, S7a, S9, and S9a were set on the projecting portions 103 of the material to be processed 100. Consequently, the temperature rise of the surface of the material to be processed 100 could be suppressed to 2 to 5° C. For example, when focusing on the four temperature measuring points S9, S10, S8a, and S9a of the material to be processed 100, the temperature rise of the surface of the material to be processed 100 could be suppressed to 3° C. or below.

After the anodization, the thickness of the anodized film formed on the surface of the material to be processed 100 was measured by a known film thickness measuring method. Consequently, the thicknesses of the anodized film were in a range, for example, from 10 μm to 15 μm at any of the temperature measuring points S1 to S10, and S1a to S10a, and variations in the film thickness were with the range from 2.1 μl to 3.1 μm. Therefore, it was found that using the anodizing apparatus 10 could suppress the variations in the thickness of the anodized film formed on the entire surface of the material to be processed 100 to a level below 5 μm, and was effective for uniformizing the film thickness.

According to the anodizing apparatus 10 having the configuration described above, by the injection of the electrolytic solution from the injection ports 24, the thickness of the anodized film formed on the upper surface 100*a* of the material to be processed 100 is suppressed from becoming larger than other parts. Also, by combining the injection ports 25 with the injection ports 24, the partial temperature rise on the upper surface 100*a* and the lower surface 100*b* of the material to be processed 100 may be suppressed. Furthermore, by combining the injection ports 23 with the injection ports 24, the partial temperature rise on the upper surface 100*a* and the projecting portions 103 of the material to be processed 100 may be suppressed. Consequently, uniformization of the film thickness of the anodized film formed on the entire surface of the material to be processed 100 is achieved during the anodization.

Second Embodiment

Figure 7:
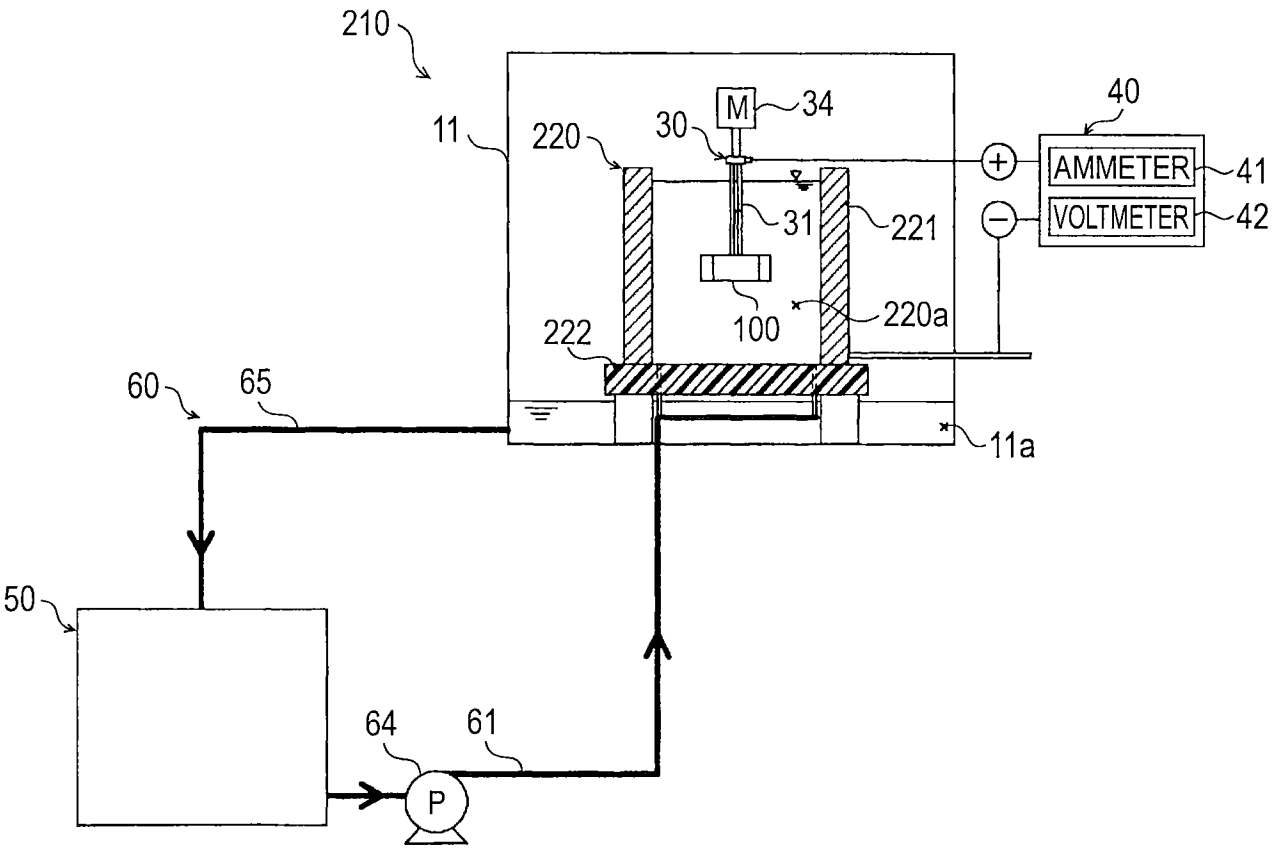
FIG. 7 is a drawing illustrating a schematic configuration of an anodizing apparatus of a second embodiment.

FIG. 7 illustrates a schematic configuration of an anodizing apparatus 210 according to a second embodiment. The anodizing apparatus 210 is provided with an electrolysis tank 220 having the same function as the electrolysis tank 20 described above, but is different from the electrolysis tank 20 in only the injection structure of the electrolytic solution in the electrolysis tank 220. Since the configuration other than the electrolytic solution injecting structure is the same as the electrolysis tank 20, only the injecting structure will be described in the following description, and other description is omitted.

A cylindrical portion (cylindrical electrode) 221 of the electrolysis tank 220 is provided with injection ports 223 communicating with the supply pipe 61 in one system of the electrolytic solution transfer apparatus 60. In other words, only injection ports 223 are employed in the electrolysis tank 220 instead of the injection ports 23, 24, and 25 of the electrolysis tank 20. The supply pipe 61 communicates with the injection ports 223 via through channels 222*a* formed in a bottom portion 222 of the electrolysis tank 220 so as to penetrate therethrough. The injection ports 223 are formed as openings on an inner wall surface (bottom surface) 221*a* of the bottom portion 222 of the electrolysis tank 220 below the material to be processed 100 retained by the retaining device 30.

Figure 8:
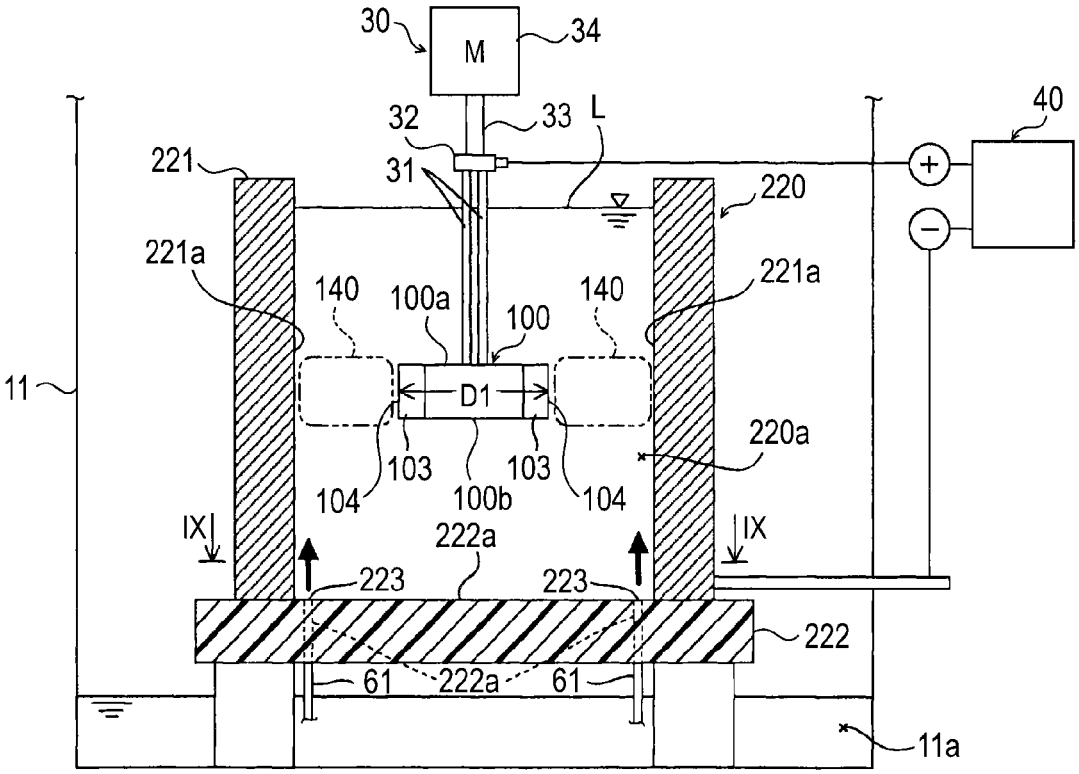
FIG. 8 is a drawing illustrating a schematic configuration of an electrolysis tank in FIG. 7.
Figure 9:
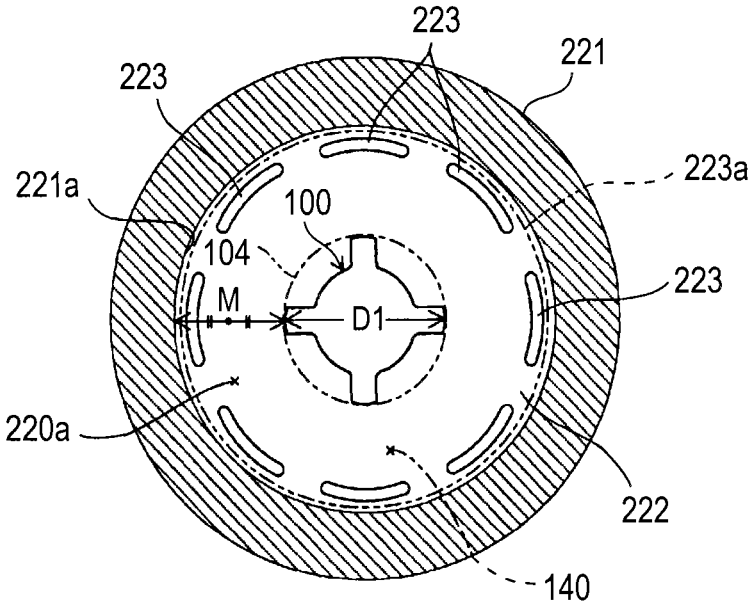
FIG. 9 is a drawing illustrating a cross-sectional structure of the electrolysis tank along IX-IX in FIG. 8.

The injection ports 223 are configured to be capable of injecting electrolytic solution toward a side area 140 on the radially outside of an outer peripheral surface of rotation 104 only in one direction (upper direction) along the outer peripheral surface of rotation 104 (the rotary peripheral trajectory (turning peripheral trajectory) illustrated by an imaginary circle C in FIG. 9) formed when the material to be processed 100 is rotated in a storage space 220*a* as illustrated in FIG. 8 and FIG. 9. The side area 140 is configured as a doughnut-shaped area as illustrated in FIG. 9. A plurality of (eight in FIG. 9) the injection ports 223 are preferably provided on an outer peripheral circle D of the bottom portion 222 of the electrolysis tank 220. In this case, the outer peripheral circle D is a concentric circle having a common center with an inner wall circle defined by the inner wall surface 221*a* of the cylindrical portion 221, has a diameter slightly smaller than the diameter of the inner wall circle. The electrolytic solution from the injection ports 223 is injected toward the side area 140 deviated from the material to be processed 100 in the storage space 220*a* of the electrolysis tank 220 so that the material to be processed 100 is deviated from lines in the directions of injection. In other words, when elongating the axial lines of injection of the injection ports 223, the material to be processed 100 does not intersect the axial lines of injection of the respective injection ports 223. Accordingly, probability that the electrolytic solution injected from the injection ports 223 is directed directly toward the material to be processed 100 is low. Therefore, variations in surface temperature of the material to be processed 100 is suppressed from occurring during the anodization by a turbulent flow caused by the direct effect of the electrolytic solution on the material to be processed 100 during the rotation. Consequently, the thickness of the anodized film formed on the surface of the material to be processed 100 is suppressed from becoming uneven. In particular, since the direction of injection of the electrolytic solution is only one direction along the outer peripheral surface of rotation 104 of the material to be processed 100, for example, occurrence of the turbulent flow due to interference of the flows of the electrolytic solution opposing to each other. Therefore, occurrence of variation in the surface temperature of the material to be processed 100 during the anodization may be suppressed reliably, and the thickness of the anodized film formed on the surface of the material to be processed 100 is suppressed further reliably from becoming uneven. The side area 140 here corresponds to the "predetermined area" and a "side area" disclosed here. The injection ports 223 constitute the injection device (which corresponds to a "first injection device" disclosed here) for injecting the electrolytic solution toward the side area 140 of the storage space 220*a* together with the electrolytic solution transfer apparatus 60.

As illustrated in FIG. 9, the plurality of injection ports 223 are preferably arranged equidistantly on the outer peripheral circle D of the bottom portion 222 of the electrolysis tank 220. Accordingly, balanced injection of the electrolytic solution from the injection ports 223 toward the side area 140 is achieved. The injection ports 223 are preferably configured to have a long hole extending in the elongated shape on the outer peripheral circle D. Accordingly, the structure for uniformizing the flow of the electrolytic solution directed upward along the inner wall surface 221*a* of the cylindrical portion 221 in terms of the circumferential direction of the inner wall surface 221*a* may be realized with a small number of injection ports.

The setting positions of the injection ports 223 may be changed as needed in a range of an area (area in the doughnut shape) segmented by the outer peripheral surface of rotation 104 of the material to be processed 100 and the inner wall surface 221*a* of the cylindrical portion 221 in FIG. 9 on the inner wall surface (bottom surface) 221*a* of the bottom portion 222 of the electrolysis tank 220. Accordingly, the probability that the flow of the electrolytic solution injected from the injection ports 223 is disturbed by the turbulence formed at a position near the material to be processed 100 being rotated is lowered. More specifically, the positions of the injection ports 223 are preferably set on the side of the inner wall surface 221*a* of the cylindrical portion 221 with respect to an intermediate position M between the inner wall surface 221*a* of the cylindrical portion 221 and the outer peripheral surface of rotation 104 of the material to be processed 100 in the radial direction of the material to be processed 100. Alternatively, the positions of the injection ports 223 are preferably set at a position apart from the outer peripheral surface of rotation 104 of the material to be processed 100 toward the inner wall surface 221*a* of the cylindrical portion 221 by ¼ or more of the outer diameter D1 of the material to be processed 100 in the radial direction of the material to be processed 100. Accordingly, the electrolytic solution being injected from the injection ports 223 and flowing upward from below the material to be processed 100 may be guided smoothly along the inner wall surface 221*a* of the cylindrical portion 221 to the side area 140. In this case, the total opening surface area of one or more of the injection ports 223 is preferably set to a range of 500 $mm^2$ or more. Accordingly, the flow rate of the electrolytic solution directed from the injection ports 223 toward the side area 140 may be suppressed to a desired level.

In the electrolysis tank 220 described above, the inner wall surface 221*a* of the bottom portion 222 may be configured as a flat surface or a curved surface. In particular, when the inner wall surface (bottom surface) 221*a* is a curved surface projecting downward, the electrolytic solution flowing downward from the lower area below the material to be processed 100 acts on the curved surface and hence may be guided easily outward toward the injection ports 223 in the vicinity of the inner wall surface 221*a* of the cylindrical portion 221. Consequently, a flow of the electrolytic solution guided from the lower area below the material to be processed 100 to the injection ports 223, and then guided to the side area 140 together with electrolytic solution injected from the injection ports 223 smoothly can be formed.

In a method of performing the anodization of the material to be processed 100 by using the anodizing apparatus 210 having the configuration described above (anodizing method), for example, steps similar to the above-described steps relating to the anodizing apparatus 10 may be employed. In other words, in the electrolysis tank 220 the electrolytic solution is injected only from the injection ports 223, so that a flow of the electrolytic solution is formed in the storage space 220*a*.

Result of Execution

According to the result of experiment in which the same anodization as in the anodizing apparatus 10 was performed by using the anodizing apparatus 210 having the configuration as described above, it was found that the temperature rise on the surface of the material to be processed 100 could be suppressed to a low level. For example, when focusing on the four temperature measuring points S9, S10, S8a, and S9a (see FIG. 6) of the material to be processed 100, the temperature rise of the surface of the material to be processed 100 could be suppressed to 1° C. or below.

As a result of measurement of the thickness of the anodized film after the anodization, the thicknesses of the anodized film were in a range of, for example, 10 μm to 15 μm and the variations in the thickness of the film were in a range of, for example, 1.9 μm to 2.8 μm in any of the temperature measuring points S1a to S10a (see FIG. 6). Therefore, it was found that using the anodizing apparatus 210 could suppress the variations in the thickness of the anodized film formed on the entire surface of the material to be processed 100 to a level below 5 μm, and was effective for uniformizing the film thickness.

According to the anodizing apparatus 210 having the configuration as described above, uniformization of the film thickness of the anodized film formed on the entire surface of the material to be processed 100 was achieved during the anodization in the same manner as a case where the anodizing apparatus 10 was used. Also, by employing the injection ports 223 communicating with the supply pipe 61 in one system of the electrolytic solution transfer apparatus 60, reductions of the installation cost and the ownership cost were achieved. As regards the installation cost, specifically, it was effective for reducing the number of installation of flowmeters relating to the injection flow rate of the electrolytic solution from the injection ports and the processing fee required for providing through channels connected to the injection ports. As regards the ownership fee, specifically, it was effective for reducing the number of steps of controlling the flow rate relating to the injection flow rate of the electrolytic solution from the injection ports.

The embodiments disclosed here are not limited to the above-described typical embodiments, and various applications and modifications may be conceivable. For example, the following modes in which the above-described embodiments are applied may be implemented.

In the anodizing apparatus 10 of the embodiment described above, the injection structure for injecting the electrolytic solution toward the areas of projecting portions 110, the upper area 120, and the lower area 130 in the storage space 20*a* is employed. However, in the embodiments disclosed here, the object is achieved only by employing at least the injection structure or the injection step for injecting the electrolytic solution from the injection ports 24 toward the upper area 120 of the storage space 20*a*. Therefore, in the embodiments disclosed here, at least one of the injection ports 23 and the injection ports 25 may be omitted depending on the design specifications or the like.

In the anodizing apparatus 210 of the embodiment described above, the injection structure in which the electrolytic solution is injected upward toward the side area 140 (the structure including the injection ports 223) is employed. Instead, however, in the embodiments disclosed here, an injection structure in which the electrolytic solution is injected downward toward the side area 140 may also be employed. In the embodiments disclosed here, various injection ports which are capable of injecting the electrolytic solution toward a predetermined area deviated from the material to be processed 100 so that the material to be processed 100 is deviated from lines in the directions of injection max be used.

In the above-described embodiments, the injection structure in which the electrolytic solution is injected into the electrolysis tank 20, 220 through the injection ports 23, the injection ports 24 and the injection ports 25 formed so as to open on the cylindrical portion 21 or the bottom portion 22 of the electrolysis tank 20 or through the injection ports 223 formed so as to open on the bottom portion 222 of the electrolysis tank 220 has been described. However, the embodiments disclosed here may employ other injection structures. For example, the anodizing apparatus may employ an injection structure in which separate piping is configured so as to open into the electrolysis tank 20, 220.

In the embodiment described above, the case where the metallic electrolysis tank 20 has a function of the electrode as a cathode has been described. However, in the embodiments disclosed here, an electrolysis tank provided with a metallic electrode portion which has a function of electrode as a cathode in the tank body formed of a material other than the metal may be used.

In the embodiments described above, the anodization of the material to be processed 100 including the disk-shaped main body portion 101 extending along the liquid surface of the electrolytic solution in the electrolysis tank 20, 220, and the plurality of projecting portions (projecting strips) 103 projecting from the main body portion 101 along the liquid surface of the electrolytic solution in the electrolysis tank 20, 220 has been described. However, the embodiments disclosed here may be applied to the anodization of the material to be processed 100 provided with one or plurality of projecting portions projecting in various directions.

In the embodiments disclosed here, the number and the size of the injection ports 23, 24, and 25 of the electrolysis tank 20 and the number and the size of the injection ports 223 of the electrolysis tank 220 may be selected as needed in accordance with various design parameters such as the size of the electrolysis tank and the amount of circulation of the electrolytic solution.

An aspect of this disclosure is directed to an apparatus for performing anodization on a metallic material to be processed provided with a projecting portion on a surface thereof, and including an electrolysis tank, a first electrode portion, a second electrode portion, an electrode apparatus, a retaining device, and a first injection device.

The electrolysis tank has a function that stores electrolytic solution for the anodization. The first electrode portion is configured as a metallic portion electrically connected to the material to be processed in an immersed state immersed in the electrolytic solution in the electrolysis tank. The second electrode portion is configured as a metallic portion and opposing the material to be processed in the immersed state. The electrode apparatus has a function that applies a predetermined voltage between the first electrode portion and the second electrode portion. By an operation of the electrode apparatus, the anodization on the material to be processed is started. The retaining device has a function that retains and rotates the material to be processed in the immersed state. Rotating the material to be processed by the retaining device during the anodization helps to remove the heat generated in the material to be processed during the anodization, and form a uniform anodized film on the entire surface of the material to be processed.

The first injection device injects the electrolytic solution for the anodization toward a predetermined area deviated from the material to be processed in a storage space in the electrolysis tank so that the material to be processed is deviated from a line in the direction of injection. In this case, the probability that the electrolytic solution injected from the first injection device is directed directly toward the material to be processed is lowered. Therefore, variations in surface temperature of the material to be processed is suppressed from occurring during the anodization by a turbulent flow caused by the direct effect of the electrolytic solution on the material to be processed during the rotation. Consequently, the thickness of the anodized film formed on the surface of the material to be processed is suppressed from becoming uneven.

In the anodizing apparatus having the configuration as described above, it is preferable that the predetermined area is a side area on the radially outside of an outer peripheral circle of rotation defined when the material to be processed rotates. In this case, it is preferable that the electrolytic solution is injected toward the side area only in one direction along the outer peripheral surface of rotation of the material to be processed. In particular, since the direction of injection of the electrolytic solution is only one direction along the outer peripheral surface of rotation of the material to be processed, for example, occurrence of the turbulent flow due to interference of the flows of the electrolytic solution opposing to each other is prevented. Therefore, variations in surface temperature of the material to be processed are reliably suppressed from occurring during the anodization. Consequently, the thickness of the anodized film formed on the surface of the material to be processed is suppressed from becoming uneven.

In the anodizing apparatus according to the aspect of this disclosure described above, it is preferable that the first injection device includes an injection port configured to inject the electrolytic solution in the bottom surface of the cylindrical electrolysis tank on the side of an inner wall surface of the electrolysis tank with respect to an intermediate position between the inner wall surface of the electrolysis tank and the outer peripheral surface of rotation of the material to be processed in terms of the radial direction of the material to be processed. In this case, the electrolytic solution injected from the injection ports and flowing upward from below the material to be processed may be guided smoothly along the inner wall surface of the electrolysis tank to the side area.

In the anodizing apparatus according to the aspect of this disclosure described above, it is preferable that the first injection device includes an injection port configured to inject the electrolytic solution in the bottom surface of the cylindrical electrolysis tank at a position apart from the outer peripheral surface of rotation of the material to be processed by ¼ or more of the outer diameter of the material to be processed on the side of the inner wall surface of the electrolysis tank in terms of the radial direction of the material to be processed. In this case, the electrolytic solution being injected from the injection ports and flowing upward from below the material to be processed may be guided smoothly along the inner wall surface of the electrolysis tank to the side area.

In the anodizing apparatus according to the aspect of this disclosure described above, it is preferable that the predetermined area is an upper area between a liquid surface of the electrolytic solution in the electrolysis tank and an upper surface of the material to be processed in the immersed state. In this case, it is preferable that the first injection device injects the electrolytic solution toward the upper area in the direction along the upper surface of the material to be processed. The electrolytic solution injected by the first injection device is capable of diffusing the electrolytic solution staying in the upper area, whereby cooling of the material to be processed is accelerated. In particular, the electrolytic solution at a high temperature can stay easily in the upper area by a convection generated by the temperature rise of the electrolytic solution at the time of the anodization, whereby the temperature of the upper surface of the material to be processed relatively rises. However, by positively injecting the electrolytic solution to the upper area, the electrolytic solution at a high temperature in the upper area is diffused and hence the temperature difference between the upper surface of the material to be processed and other portions may be cancelled. Consequently, the thickness of the anodized film formed on the upper surface of the material to be processed is suppressed from becoming larger than that on other portions.

In the anodizing apparatus according to the aspect of this disclosure described above, it is preferable that the first injection device has a function that injects the electrolytic solution toward a center axis of rotation of the material to be processed in the upper area. In this case, in addition to an effect of diffusing the electrolytic solution staying in the upper area, a cooling effect for cooling the upper surface of the material to be processed is improved by the electrolytic solution injected toward the center axis of rotation of the material to be processed.

In the anodizing apparatus according to the aspect of this disclosure described above, it is preferable that the first injection device has a function that injects the electrolytic solution toward an area closer to the upper surface of the material to be processed than to the liquid surface of the electrolytic solution in the electrolysis tank. Accordingly, the effect of diffusing the electrolytic solution staying in the upper area is improved, and the cooling effect for cooling the upper surface of the material to be processed is improved.

In the anodizing apparatus according to the aspect of this disclosure described above, it is preferable that the anodizing apparatus further includes a second injection device. The second injection device is configured to inject the electrolytic solution for the anodization toward a lower area between the bottom surface of the electrolysis tank and the lower surface of the material to be processed in the immersed state. The lower surface is positively cooled by the direct effect of the electrolytic solution injected by the second injection device to the lower surface of the material to be processed. The electrolytic solution injected by the second injection device is capable of suppressing local stay of the electrolytic solution by the diffusing effect of the electrolytic solution in the lower area, whereby cooling of the material to be processed may be accelerated. By combining the first injection device and the second injection device, the partial temperature rise on the upper surface and the lower surface of the material to be processed may be suppressed. Consequently, uniformization of the film thickness of the anodized film formed on the entire surface of the material to be processed is achieved during the anodization.

In the anodizing apparatus according to the aspect of this disclosure described above, it is preferable that the anodizing apparatus further includes a third injection device. The third injection device is configured to inject the electrolytic solution for the anodization toward a projecting portion on the material to be processed in the immersed state. The electrolytic solution injected by the third injection device acts directly on the projecting portion of the material to be processed. The projecting portion of the material to be processed is susceptible to increase in temperature due to a power concentration and, consequently, the thickness of the anodized film formed on the projecting portions tends to be relatively larger. However, by positively cooling the projecting portion, the thickness of the anodized film formed on the surfaces of the projecting portions is prevented from becoming thicker than that on other parts. By combining the first injection device and the third injection device, the partial temperature rise on the upper surface and the projecting portion of the material to be processed may be suppressed. Consequently, uniformization of the film thickness of the anodized film formed on the entire surface of the material to be processed is achieved during the anodization.

Another aspect of this disclosure is directed to a method of anodizing a metallic material to be processed provided with a projecting portion on the surface thereof, and including one or more steps. The steps include immersing the material to be processed in an electrolysis tank in which electrolytic solution for the anodization is stored, rotating the material to be processed, and applying a predetermined voltage between a first electrode portion electrically connected to the material to be processed in the immersed state and a second electrode provided at a position opposing the material to be processed in the immersed state in the electrolysis tank. In the steps, the electrolytic solution for the anodization is injected toward a predetermined area deviated from the material to be processed in a storage space in the electrolysis tank so that the material to be processed is deviated from a line in the direction of injection. In this case, the probability that the electrolytic solution is directed directly toward the material to be processed is lowered. Therefore, variations in surface temperature of the material to be processed are suppressed from occurring during the anodization by a turbulent flow caused by the direct effect of the electrolytic solution on the material to be processed during the rotation. Consequently, the thickness of the anodized film formed on the surface of the material to be processed is suppressed from becoming uneven.

In the anodizing method according to the aspect of this disclosure described above, it is preferable that the predetermined area is a side area on the radially outside of an outer peripheral surface of rotation defined when the material to be processed rotates. In this case, it is preferable that, in the above-described step, the electrolytic solution is injected toward the side area only in one direction along the outer peripheral surface of rotation of the material to be processed. In particular, since the direction of injection of the electrolytic solution is only one direction along the outer peripheral surface of rotation of the material to be processed, for example, occurrence of the turbulent flow due to interference of the flows of the electrolytic solution opposing to each other is prevented. Therefore, variations in surface temperature of the material to be processed are reliably suppressed from occurring during the anodization. Consequently, the thickness of the anodized film formed on the surface of the material to be processed is suppressed from becoming uneven.

In the anodizing method according to the aspect of this disclosure described above, it is preferable that the predetermined area is an upper area between a liquid surface of the electrolytic solution in the electrolysis tank and an upper surface of the material to be processed in the immersed state. In this case, it is preferable that, in the above-described step, the electrolytic solution is injected toward the upper area only in the direction along the upper surface of the material to be processed. Accordingly, the electrolytic solution staying in the upper area is diffused so that cooling of the material to be processed is accelerated. Consequently, the thickness of the anodized film formed on the upper surface of the material to be processed is suppressed from becoming larger than that on other portions.

As described above, according to this disclosure, in the anodization of the metallic material to be processed provided with the projecting portion on the surface thereof, uniformization of the thickness of the anodized film may be achieved.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An anodizing apparatus configured to perform an anodization on a metallic material to be processed provided with a projecting portion on a surface thereof, comprising:

an electrolysis tank configured to store electrolytic solution for anodization;

a first electrode portion formed of a metal and electrically connected to the material to be processed in an immersed state immersed in the electrolytic solution in the electrolysis tank;

a second electrode portion formed of a metal and opposing the material to be processed in the immersed state;

an electrode apparatus configured to apply a predetermined voltage between the first electrode portion and the second electrode portion;

a retaining device configured to retain and rotate the material to be processed in the immersed state; and a first injection device configured to inject the electrolytic solution for the anodization toward a predetermined area deviated from the material to be processed in a storage space in the electrolysis tank so that the material to be processed is deviated from a line in the direction of injection, wherein the predetermined area is a side area on the radially outside of an outer peripheral surface of rotation defined when the material to be processed rotates, the first injection device injects the electrolytic solution toward the side area only in one direction along the outer peripheral surface of rotation of the material to be processed, and the first injection device includes an injection port configured to inject the electrolytic solution in a bottom surface of the electrolysis tank on the side of an inner wall surface of the electrolysis tank with respect to an intermediate position between the inner wall surface of the electrolysis tank and the outer peripheral surface of rotation of the material to be processed in terms of the radial direction of the material to be processed.

2. The anodizing apparatus according to claim 1, wherein the injection port is configured to inject the electrolytic solution in the bottom surface of the electrolysis tank at a position apart from the outer peripheral surface of rotation of the material to be processed by ¼ or more of the outer diameter of the material to be processed on the side of an inner wall surface of the electrolysis tank in terms of the radial direction of the material to be processed.

3. The anodizing apparatus according to claim 1, further comprising:

a second injection device configured to inject the electrolytic solution for the anodization toward a lower area between the bottom surface of the electrolysis tank and the lower surface of the material to be processed in the immersed state.

4. The anodizing apparatus according to claim 3, further comprising:

a third injection device configured to inject the electrolytic solution for the anodization toward the projecting portion on the material to be processed in the immersed state.

* * * * *